US006537158B2

(12) United States Patent
Watanabe

(10) Patent No.: US 6,537,158 B2
(45) Date of Patent: Mar. 25, 2003

(54) MULTI-PIECE SOLID GOLF BALL

(75) Inventor: Hideo Watanabe, Chichibu (JP)

(73) Assignee: Bridgestone Corporation Co., Ltd., Tokyo (JP)

( * ) Notice: Subject to any disclaimer, the term of this patent is extended or adjusted under 35 U.S.C. 154(b) by 0 days.

(21) Appl. No.: 09/840,123

(22) Filed: Apr. 24, 2001

(65) Prior Publication Data

US 2002/0042311 A1 Apr. 11, 2002

(30) Foreign Application Priority Data

Apr. 24, 2000 (JP) ..... 2000-122179

(51) Int. Cl.[7] ..... A63B 37/06
(52) U.S. Cl. ..... 473/374
(58) Field of Search ..... 473/370, 367, 473/368, 371, 373, 374, 377

(56) References Cited

U.S. PATENT DOCUMENTS 4,570,937 A * 2/1986 Yamada ..... 473/377
4,714,253 A * 12/1987 Nakahara et al. ..... 473/373
5,184,828 A 2/1993 Kim et al.
5,403,010 A * 4/1995 Yabuki et al. ..... 473/377
5,516,110 A * 5/1996 Yabuki et al. ..... 473/377
5,556,098 A * 9/1996 Higuchi et al. ..... 473/373
5,562,287 A * 10/1996 Endo et al. ..... 473/377
5,607,366 A * 3/1997 Yokota et al. ..... 473/372
5,711,723 A 1/1998 Hiraoka et al.
5,803,833 A * 9/1998 Nakamura et al. ..... 473/377

FOREIGN PATENT DOCUMENTS

JP 2614791 2/1997
JP 2880688 1/1999

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A multi-piece solid golf ball comprising a solid core, an intermediate layer, and a cover is improved in flight distance, feel and durability when the solid core has a maximum hardness at a position spaced 3–10 mm inward from its surface, the difference between the maximum hardness and the hardness at its center is at least 3 JIS-C hardness units, and the intermediate layer is softer than the cover.

16 Claims, 1 Drawing Sheet

MULTI-PIECE SOLID GOLF BALL

This invention relates to multi-piece solid golf balls having improved flight performance, feel and durability.

BACKGROUND OF THE INVENTION

For the purpose of improving the feel and other properties of two-piece solid golf balls, efforts have been made to develop multi-piece solid golf balls, typically three-piece solid golf balls. For example, Japanese Patent Nos. 2,614,791 and 2,880,688 disclose three-piece solid golf balls which are improved by controlling the hardness distribution of the solid core.

Japanese Patent No. 2,614,791 intends to improve the rebound and distance properties of the ball while maintaining appropriate spin, by maximizing the surface hardness of the core and gradually reducing the hardness of the core from its surface to its center. The present inventor found that the ball lacked anti-cracking durability when the surface hardness was maximum in the hardness distribution of the core. The ball cracked after a relatively small number of shots.

Japanese Patent No. 2,880,688 intends to improve the distance and controllability of the ball by minimizing the hardness distribution of the core. This patent discloses only those golf balls whose core has a substantially flat hardness distribution or a maximum hardness at its surface. The present inventor found that those golf balls whose core has a substantially flat hardness distribution or a maximum hardness at its surface and a reduced hardness difference between the surface and the center of the core have such spin properties that the flight performance on driver shots is less satisfactory (high spin receptivity on driver shots).

SUMMARY OF THE INVENTION

An object of the invention is to provide a multi-piece solid golf ball having improved flight performance, feel and anti-cracking durability.

The invention pertains to a multi-piece solid golf ball of three or more layer structure comprising a solid core, an intermediate layer, and a cover. The inventor has found that the ball is optimized in spin so as to acquire satisfactory flight performance when the hardness distribution of the solid core is adjusted such that the core does not have a maximum hardness at its surface, but has a peak or maximum hardness at a position spaced 3 to 10 mm radially inward from its surface, and the difference between the maximum hardness and the hardness at the core center is at least 3 JIS-C hardness units, and when the intermediate layer has a lower hardness than the cover. In addition, the ball offers a good feel when hit and is durably resistant to cracks so that the ball remains non-cracked after a large number of shots.

Therefore, the invention provides a multi-piece solid golf ball comprising a solid core, an intermediate layer around the core, and a cover around the intermediate layer, wherein the solid core has a maximum hardness at a position spaced 3 to 10 mm radially inward from its surface and a hardness at its center, the difference between the maximum hardness and the center hardness is at least 3 JIS-C hardness units, and the intermediate layer is softer than the cover.

BRIEF DESCRIPTION OF THE DRAWINGS

The above aspects of the present invention will become more apparent by describing in detail embodiments thereof with reference to the attached drawings, in which.

DESCRIPTION OF THE PREFERRED EMBODIMENT

Figure 1:
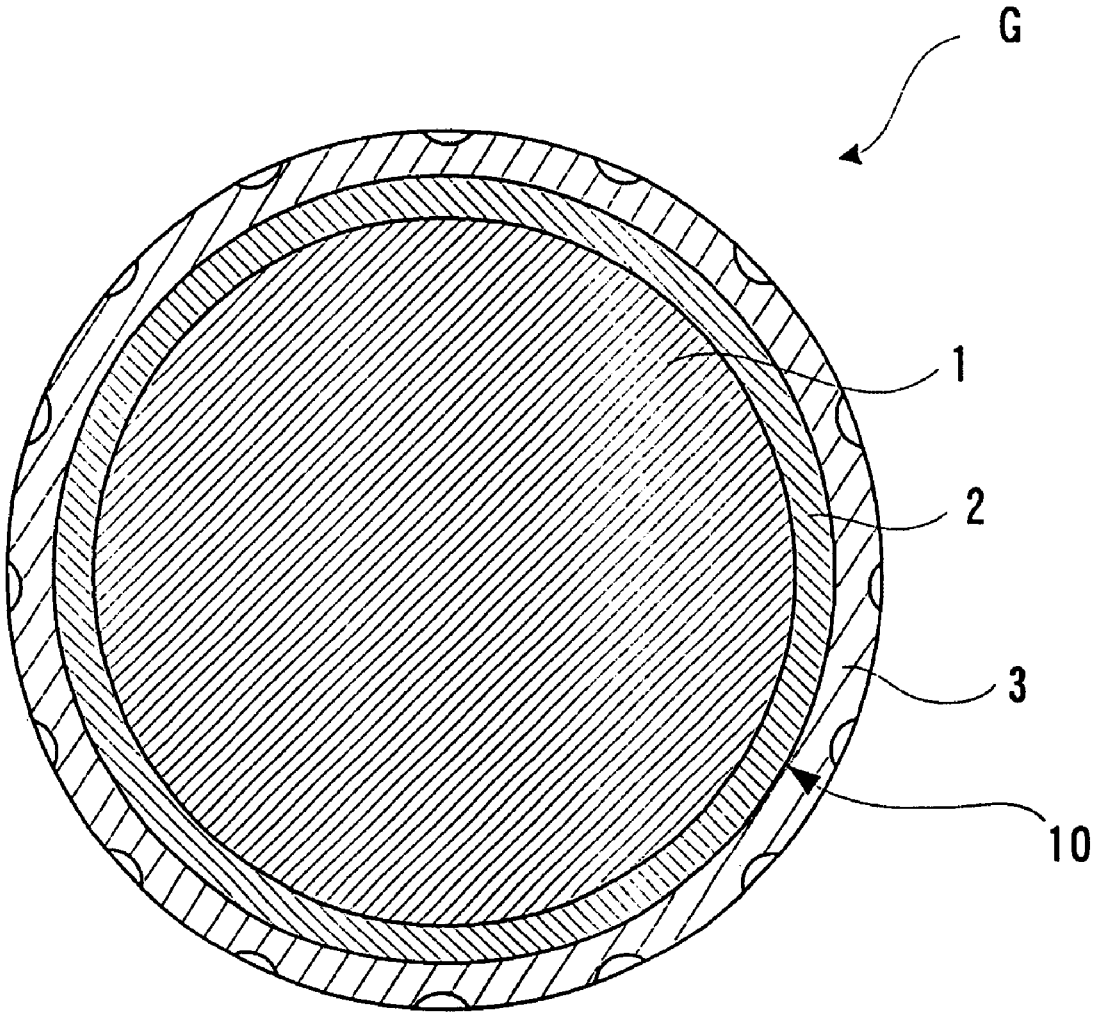
FIG. 1 is a cross-sectional view of a multi-layered golf ball of the present invention.

The golf ball G of the invention is a multi-piece solid golf ball of a three or more layer structure comprising at least a solid core 1 (or innermost layer), a cover 3 (or outermost layer), and an intermediate layer 2 between the core 1 and the cover 3, as shown in FIG. 1. If desired, another layer intervenes between the core 1 and the intermediate layer 2 or between the intermediate layer 2 and the cover 3. A spherical body 10 is also obtained by enclosing the core 1 with at least one intermediate layer 2.

The solid core may be formed of a rubber composition comprising as a base rubber polybutadiene, especially cis-1,4-polybutadiene having at least 40% of cis configuration. The core material is not limited to the rubber composition as long as the core is given a specific hardness distribution to be defined later.

Usually the rubber composition includes a base rubber, crosslinking agent, vulcanizing agent, filler and other components. The base rubber is polybutadiene, especially cis-1,4-polybutadiene having at least 40%, especially at least 90% of cis configuration as mentioned just above. Any of natural rubber, polyisoprene and styrene-butadiene rubber is compounded therewith if desired.

The crosslinking agent used in the rubber composition may be selected from zinc and magnesium salts of unsaturated fatty acids such as zinc dimethacrylate and zinc diacrylate and esters of unsaturated fatty acids such as trimethylolpropane trimethacrylate. Zinc diacrylate is especially preferred for high restitution. The crosslinking agent is preferably used in an amount of about 15 to 45 parts by weight per 100 parts by weight of the base rubber.

Many organic peroxides are useful, for example, dicumyl peroxide, 1,1-bis(t-butylperoxy)-3,3,5-trimethylcyclohexane, and 2,5-dimethyl-2,5-di-t-butylperoxyhexyne-3 alone and in admixture of any. The organic peroxide (or crosslinking agent) is preferably blended in an amount of about 0.1 to 5 parts by weight per 100 parts by weight of the base rubber. Commercially available peroxides are Percumyl D and Perhexyne 2,5B (by NOF Co., Ltd.) and Trigonox 29-40 white powder (by Kayaku Akzo K. K.). In the rubber composition, there may be blended antioxidants and specific gravity-adjusting fillers such as zinc oxide and barium sulfate, if desired.

According to the invention, the solid core itself must have an optimized hardness distribution as expressed in JIS-C hardness between the center and the surface thereof. The solid core has a maximum hardness at a position spaced 3 to 10 mm radially inward from its surface. If the hardness peaks at a position spaced more than 10 mm inward from the core surface, the ball may have a higher spin rate on driver shots and travel less. If the maximum hardness is positioned within 3 mm from the core surface, the ball may become less durable to crack resistant. The preferred position of maximum hardness is from 4 mm to 9 mm, especially from 5 mm to 8 mm inward from the core surface.

The solid core should have such a hardness distribution that the maximum hardness appears at a position spaced 3 to 10 mm radially inward from its surface and the difference between the maximum hardness and the hardness at the core center is at least 3 JIS-C hardness units. The preferred difference between the maximum hardness and the center hardness is at least 5 units, more preferably at least 7 units and up to 15 units, more preferably up to 12 units in JIS-C hardness. Further preferably, the core at the center has a JIS-C hardness of 55 to 75, more preferably 58 to 72, most preferably 60 to 70. The difference between the maximum hardness and the hardness at the core surface is preferably 2 to 10 units, more preferably 3 to 8 units, most preferably 4 to 6 units in JIS-C hardness.

It is recommended that the solid core have a compression of at least 3.0 mm, preferably at least 3.2 mm, especially at least 3.4 mm and up to 6.0 mm, preferably up to 5.2 mm, especially up to 4.5 mm. "Compression," as used herein, refers to the amount (mm) of deflection or deformation the core incurs when subjected to a load of 1,275 N (130 kgf) from an initial load of 98 N (10 kgf). If the solid core has too low compression, the ball on driver shots may feel hard and have a higher spin rate, resulting in a shortened distance of travel due to skying. With too high compression of the core, the ball on driver shots may give a feel that is too soft and have insufficient rebound, which can also shorten the distance of travel by the ball. Anti-cracking durability is sometimes poor.

The solid core is prepared from the core-forming rubber composition described above by milling the necessary components in a conventional mixer such as a Banbury mixer, kneader or roll mill, and molding the compound in a suitable mold as by compression molding. Several procedures may be used in order to accomplish the above-defined hardness distribution and compression. One exemplary procedure (1) includes using a mixture of 2,5-dimethyl-2,5-di-t-butylperoxyhexyne-3 and 1,1-bis(t-butylperoxy)-3,3,5-trimethylcyclohexane as the peroxide and vulcanizing at a temperature of 140 to 180° C., preferably 145 to 175° C. Another effective procedure (2) is by vulcanizing the rubber composition with dicumyl peroxide while changing the temperature stepwise. Typically procedure (2) includes vulcanizing steps at 120 to 140° C. for 3 to 5 minutes, then at 130 to 150° C. for 5 to 20 minutes, and further at 140 to 160° C. for 5 to 20 minutes. The molding procedure is not limited to these, and appropriate conditions may be selected for a particular core material (rubber composition) so as to achieve the target core hardness distribution.

The diameter of the solid core is usually at least 32.0 mm, preferably at least 35.0 mm, and up to 38.7 mm, preferably up to 37.0 mm, though not limited thereto. It is recommended that the weight of the solid core is usually at least 20 g, especially at least 25 g and up to 36 g, especially up to 32 g.

The intermediate layer is formed between the solid core and the cover. The intermediate layer is preferably formed mainly of a thermoplastic resin as a relatively soft, highly resilient layer.

The thermoplastic resins of which the intermediate layer is formed include ionomer resins and thermoplastic elastomers. Exemplary thermoplastic elastomers include polyester, polyamide, polyurethane, olefin and styrene thermoplastic elastomers. They are commercially available under the trade name of Hytrel from Dupont-Toray Co., Ltd., Perprene from Toyobo Co., Ltd., Pebax from Toray Co., Ltd., Pandex from Dai-Nippon Ink and Chemicals Co., Ltd., Santoprene from Monsanto Co., Toughtec from Asahi Chemical Industry Co., Ltd. and Dynalon from JSR Co., Ltd.

In the thermoplastic resins, suitable amounts of various additives such as inorganic fillers may be blended. Typical inorganic fillers are barium sulfate and titanium dioxide. The inorganic fillers may be surface treated so as to facilitate the dispersion in resins.

The intermediate layer can be formed by well-known methods, for example, injection molding and compression molding. In the case of injection molding, the solid core is held in place in an injection mold, and the above material is injected into the mold. The compression molding method includes forming a pair of half cups from the above material, and encasing the core with the half cups, followed by heating under pressure in a mold.

The intermediate layer should preferably have a Shore D hardness of at least 25, more preferably at least 35 and up to 60, more preferably up to 55. With too low a Shore D hardness, the ball may receive more spin on driver shots, resulting in a shorter distance of travel. Too high a Shore D hardness may lead to a poor feel.

It is recommended that the thickness or gage of the intermediate layer is up to 3 mm, preferably up to 2.3 mm and especially up to 2 mm, though not critical. If the intermediate layer is too thick, the ball may not be improved in feel and distance. The lower limit of the intermediate layer thickness is at least 0.8 mm, especially at least 1.2 mm.

It is noted that a spherical body obtained by enclosing the core with the intermediate layer preferably has a compression of 2.0 to 5.0 mm, more preferably 2.5 to 4.5 mm, and most preferably 3.0 to 4.0 mm.

The golf ball of the invention is provided with the cover as the outermost layer. The cover may be a single layer or a multilayer cover of two or more layers. The multilayer cover includes at least a layer defining the outermost surface and a layer disposed inside. In this case, the term "cover" means the entire multilayer structure which should meet the cover requirement of the invention, and any cover layer disposed inside the outermost layer is distinguished in this sense from the intermediate layer.

The cover may be formed of well-known materials based on thermoplastic resins. Ionomer resins are typical. Commercially available are Himilan from Dupont-Mitsui Polychemical Co., Ltd., Surlyn from E. I. DuPont de Nemours and Company, and Iotek from Exxon Chemical Company. Various additives such as inorganic fillers may be blended therewith in suitable amounts. Suitable inorganic fillers are as described in conjunction with the intermediate layer.

Like the intermediate layer, the cover may be formed from the above material by injection molding, compression molding and other methods.

The thickness or gage of the cover is at least 1.0 mm, especially at least 1.6 mm and up to 2.5 mm, especially up to 2.3 mm. A thinner cover may be less durable and liable to crack whereas a thicker cover may lead to a dull feel.

According to the invention, the cover is harder than the intermediate layer. Specifically, the cover should preferably have a Shore D hardness of at least 56, especially at least 60. With too low a Shore D hardness of the cover, the ball may become less rebound and travel short. The upper limit of the cover's Shore D hardness is preferably up to 68, especially up to 65. With too high a Shore D hardness of the cover, the feel may become hard.

Insofar as the intermediate layer is softer than the cover, the hardness difference between the cover and the intermediate layer is not critical, but preferably in the range of 5 to 40 units, especially 10 to 30 units in Shore D hardness.

It is recommended that the multi-piece solid golf ball thus constructed itself has a compression of at least 2.2 mm, especially at least 2.4 mm and up to 3.6 mm, especially up to 3.3 mm.

The multi-piece solid golf ball has a plurality of dimples in its surface. The shape and arrangement of dimples may be set as in conventional golf balls. If desired, the ball is subjected to finishing treatments including painting and stamping.

The multi-piece solid golf ball has a diameter and a weight as prescribed by the Rules of Golf, specifically a diameter of not less than 42.67 mm and a weight of not greater than 45.93 g.

There has been described a multi-piece solid golf ball having improved flight performance, good feel and high durability.

EXAMPLE

Examples of the present invention are given below together with Comparative Examples by way of illustration and not by way of limitation.

Examples & Comparative Examples

Rubber compositions of the core formulation shown in Table 1 were intimately milled and admitted into core molds where they were vulcanized under the conditions shown in Table 1 to form solid cores. The hardness distribution and parameters of the solid cores are shown in Table 1.

There were separately furnished intermediate layer materials and cover materials of the formulation shown in Table 2. The intermediate layer and the cover were successively injection molded over the solid core, obtaining three-piece solid golf balls having parameters as shown in Table 3.

The golf balls were examined for flight, feel and anti-cracking durability by the following tests. The results are shown in Table 3.

Flight Performance

Using a swing robot, the ball was hit with a driver (W#1) at a head speed (HS) of 45 m/s. Carry, total distance and spin rate were measured. The ball was rated as follows.

Good: total distance≧217 m

Poor: total distance≦216 m

Putter Feel

Ten skilled amateur golfers hit the ball with a putter to examine the feel. The ball was rated as follows.

Soft: soft pleasant feel

Hard: hard feel

Anti-cracking Durability

Using a swing robot, the ball was repeatedly and randomly hit with a driver at a head speed of 40 m/s. Ten balls were tested in each Example and the number of shots when any one of ten balls cracked was recorded. The ball was rated as follows.

Good: no cracks after 280 shots

Poor: cracked within 240 shots

TABLE 1

| | CORE | | | | | | |
|---|---|---|---|---|---|---|---|
| | Example | | | Comparative Example | | | |
| | 1 | 2 | 3 | 1 | 2 | 3 | 4 |
| Core formulation (pbw) | | | | | | | |
| Polybutadiene | 100 | 100 | 100 | 100 | 100 | 100 | 100 |
| Zinc diacrylate | 31.5 | 29.4 | 27.5 | 27.5 | 34 | 31.5 | 27.5 |
| Peroxide (1) | 0 | 0 | 0 | 0.6 | 0.6 | 0 | 0 |
| Peroxide (2) | 0.8 | 0.8 | 0.8 | 0.6 | 0.6 | 0.8 | 0.8 |
| Peroxide (3) | 1 | 1 | 1 | 0 | 0 | 1 | 1 |
| Antioxidant | 0.2 | 0.2 | 0.2 | 0.2 | 0.2 | 0.2 | 0.2 |
| Zinc oxide | 10.1 | 11.1 | 11.9 | 12.4 | 9.5 | 29.8 | 11.9 |
| Zinc salt of pentachlorothiophenol | 1 | 1 | 1 | 1 | 1 | 1 | 1 |
| Zinc stearate | 5 | 5 | 5 | 5 | 5 | 5 | 5 |
| Vulcanization | | | | | | | |
| 1st stage (temp./time) | 155° C./15 min | 155° C./15 min | 155° C./15 min | 155° C./15 min | 140° C./30 min | 155° C./15 min | 155° C./15 min |
| 2nd stage (temp./time) | — | — | — | — | 165° C./15 min | — | — |
| Core hardness distribution (JIS C) | | | | | | | |
| Surface | 74 | 70 | 68 | 75 | 77 | 74 | 69 |
| 15 mm from center | 74 | 70 | 63 | 70 | 76 | 74 | 68 |
| 12.5 mm from center | 79 | 75 | 69 | 70 | 76 | 79 | 69 |
| 10 mm from center | 77 | 76 | 71 | 67 | 76 | 77 | 71 |
| 7.5 mm from center | 74 | 72 | 69 | 65 | 75 | 74 | 69 |
| 5 mm from center | 71 | 70 | 67 | 63 | 74 | 71 | 67 |
| 2.5 mm from center | 69 | 69 | 67 | 62 | 73 | 69 | 67 |
| Center | 68 | 69 | 67 | 60 | 73 | 68 | 67 |
| Hardness difference (Max − Min) | 11 | 7 | 4 | 15 | 4 | 11 | 4 |

TABLE 1-continued

| CORE | Example | | | Comparative Example | | | |
|---|---|---|---|---|---|---|---|
| | 1 | 2 | 3 | 1 | 2 | 3 | 4 |
| Core | | | | | | | |
| Outer diameter (mm) | 35.1 | 35.2 | 35.1 | 35.2 | 35.2 | 35.1 | 38.6 |
| Weight (g) | 25.2 | 25.4 | 25.3 | 25.4 | 25.5 | 27.8 | 33.6 |
| Compression (mm) | 3.2 | 3.6 | 3.9 | 4.3 | 3.1 | 3.2 | 3.9 |

Note:
Peroxide (1) is dicumyl peroxide commercially available under the trade name of Percumyl D from NOF Co., Ltd.
Peroxide (2) is 1,1-bis(t-butylperoxy)-3,3,5-trimethylcyclohexane commercially available under the trade name of Trigonox 29-40 white powder from Kayaku Akzo K.K.
Peroxide (3) is a 40% dilution of 2,5-dimethyl-2,5-di-t-butylperoxyhexyne-3 commercially available under the trade name of Perhexyne 2,5B from NOF Co., Ltd.
The antioxidant is Nocrack NS-6 from Ouchi Shinko Kagaku K.K.
Compression is the amount (mm) of deflection or deformation the core incurs when subjected to a load of 1,275 N (130 kgf) from an initial load of 98 N (10 kgf).

TABLE 2

| Intermediate layer/Cover | | | | | |
|---|---|---|---|---|---|
| Designation | | a | b | c | D |
| Formulation (pbw) | Himilan 1706 Zn | | | 50 | |
| | Himilan 1557 Zn | 50 | | | |
| | Himilan 1605 Na | | | 50 | |
| | Himilan 1601 Na | 50 | | | |
| | Surlyn 8120 Na | | | | 100 |
| | Hytrel 4047 | | 100 | | |
| | Barium sulfate 300 | 27 | | | |
| | Titanium oxide | 5.6 | | 5 | 5 |
| Shore D hardness | | 62 | 40 | 63 | 45 |

has poor anti-cracking durability. The ball of Comparative Example 2 wherein the core has such a hardness distribution that the surface hardness is maximum and the difference between maximum and minimum hardnesses is small receives a more spin rate on driver shots, and travels a shorter distance. The ball of Comparative Example 3 wherein the core has the specific hardness distribution, but the intermediate layer is harder than the cover travels short on driver shots because of a more spin rate and less rebound. The two-piece golf ball of Comparative Example 4 has a poor feel.

In contrast, the golf balls of Examples within the scope of the invention are excellent in all of flight distance, feel and durability.

TABLE 3

| | | Example | | | Comparative Example | | | |
|---|---|---|---|---|---|---|---|---|
| | | 1 | 2 | 3 | 1 | 2 | 3 | 4 |
| Intermediate layer | Material | b | b | b | b | b | c | — |
| | Outer diameter (mm) | 38.6 | 38.6 | 38.6 | 38.6 | 38.6 | 38.6 | — |
| | Gage (mm) | 1.75 | 1.70 | 1.76 | 1.70 | 1.70 | 1.75 | — |
| | Weight (g) | 33.6 | 33.6 | 33.6 | 33.6 | 33.7 | 35.2 | — |
| | Compression (mm) | 3.2 | 3.6 | 3.9 | 4.0 | 3.0 | 2.7 | — |
| Cover | Material | a | a | a | a | a | d | a |
| | Gage (mm) | 2.05 | 2.05 | 2.05 | 2.05 | 2.05 | 2.05 | 2.05 |
| Ball | Outer diameter (mm) | 42.7 | 42.7 | 42.7 | 42.7 | 42.7 | 42.7 | 42.7 |
| | Weight (g) | 45.6 | 45.6 | 45.5 | 45.6 | 45.5 | 45.5 | 45.5 |
| | Compression (mm) | 2.9 | 3.1 | 3.3 | 3.3 | 2.6 | 2.5 | 3.2 |
| Flight performance (W#1/HS45) | Carry (m) | 205.2 | 205.0 | 204.3 | 201.4 | 205.5 | 195.1 | 202.7 |
| | Total (m) | 220.1 | 217.7 | 217.5 | 219.8 | 215.7 | 207.0 | 221.0 |
| | Spin (rpm) | 3058 | 3029 | 2973 | 2769 | 3117 | 3560 | 2801 |
| | Flight | Good | Good | Good | Good | Poor | Poor | Good |
| Putter feel | | Soft | Soft | Soft | Soft | Soft | Soft | Hard |
| Anti-cracking durability (random shots/HS40) | | Good | Good | Good | Poor | Good | Good | Good |

Note that the compression of the intermediate layer is that of a spherical body obtained by enclosing the core with the intermediate layer, and the compression of the ball is that of the completed ball.

As is evident from Table 3, the ball of Comparative Example 1 wherein the core has such a hardness distribution that the surface hardness is maximum and the difference between maximum and minimum hardnesses is substantial Japanese Patent Application No. 2000-122179 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A multi-piece solid golf ball comprising a solid core, an intermediate layer around the core, and a cover around the intermediate layer, wherein said solid core has a diameter of 32.0 to 38.7 mm and a maximum hardness at a position spaced 4 to 9 mm radially inward from its surface and a hardness at its center, the difference between the maximum hardness and the center hardness being at least 3 JIS-C hardness units, and said intermediate layer is softer than said cover, wherein said solid core has a compression of 3.2 to 5.2 mm and a spherical body obtained by enclosing the solid core with the intermediate layer has a compression of 2.5 to 4.5 mm, and said ball composed of said solid core, said intermediate layer and said cover has a compression of 2.4 to 3.6 mm, wherein said compression refers to the amount of deflection incurred by each of the solid core, the spherical body and the ball when subjected to a load of 1,275N from an initial load of 98N.

2. The golf ball of claim 1, wherein said solid core has a JIS-C hardness of 55 to 75 at its center.

3. The golf ball of claim 1 wherein the intermediate layer comprises a thermoplastic resin.

4. The golf ball of claim 1, wherein said solid core has a maximum hardness at a position spaced 5 mm to 8 mm radially inward from its surface.

5. The golf ball of claim 1, wherein the difference between the maximum hardness and the hardness at the core center is from 3 to 15 units in JIS-C hardness.

6. The golf ball of claim 1, wherein the difference between the maximum hardness and the hardness at the core center is from 5 to 12 units in JIS-C hardness.

7. The golf ball of claim 1, wherein said solid core has a JIS-C hardness of 58 to 72 at its center.

8. The golf ball of claim 5, wherein the difference between the maximum hardness and the hardness at the core surface is from 2 to 10 units in JIS-C hardness.

9. The golf ball of claim 1, wherein the intermediate layer is formed of mainly materials including ionomer resins and thermoplastic elastomers which further include polyester, polyamide, polyurethane, olefin and styrene thermoplastic elastomers.

10. The golf ball of claim 9, wherein the intermediate layer has a Shore D hardness of 25 to 60.

11. The golf ball of claim 9, wherein the intermediate layer has a Shore D hardness of 35 to 55.

12. The golf ball of claim 1, wherein the intermediate layer has a thickness of 0.8 to 3 mm.

13. The golf ball of claim 9, wherein the cover is formed of materials based on thermoplastic resin.

14. The golf ball of claim 13, wherein the cover is formed of ionomer resins.

15. The golf ball of claim 13, wherein the cover has a Shore D hardness of 56 to 68.

16. The golf ball of claim 1, wherein the cover has a thickness of 1.0 to 2.5 mm.

* * * * *

UNITED STATES PATENT AND TRADEMARK OFFICE

CERTIFICATE OF CORRECTION

PATENT NO. : 6,537,158 B2
DATED : March 25, 2003
INVENTOR(S) : Hideo Watanabe

It is certified that error appears in the above-identified patent and that said Letters Patent is hereby corrected as shown below:

Title page,
Item [73], Assignee, change "Bridgestone Corporation Co., Ltd." to -- Bridgestone Sports Co., Ltd. --

Signed and Sealed this

Twelfth Day of October, 2004

JON W. DUDAS
*Director of the United States Patent and Trademark Office*